US005138191A

United States Patent [19]

Mizushima et al.

[11] Patent Number: 5,138,191

[45] Date of Patent: Aug. 11, 1992

[54] PHOTOEMITTER

[75] Inventors: Yoshihiko Mizushima; Toru Hirohata; Tsuneo Ihara; Minoru Niigaki; Kenichi Sugimoto; Koichiro Oba; Toshihiro Suzuki; Tomoko Suzuki, all of Shizuoka, Japan

[73] Assignee: Hamamatsu Photonics K. K., Shizuoka, Japan

[21] Appl. No.: 546,753

[22] Filed: Jul. 2, 1990

[51] Int. Cl.[5] ..... H01J 1/34

[52] U.S. Cl. ..... 307/311; 357/4; 357/15; 357/30; 313/542

[58] Field of Search ..... 357/17, 30 L, 30 C, 357/30 Q, 30 R, 30 D, 29, 30 D; 313/542, 498, 499

[56] References Cited

U.S. PATENT DOCUMENTS

| | | | |
|---|---|---|---|
| 3,958,143 | 5/1976 | Bell | 313/94 |
| 4,527,179 | 7/1985 | Yamazaki | 357/17 |
| 4,694,312 | 9/1987 | Yamazaki | 357/17 |
| 4,920,387 | 4/1990 | Takasu et al. | 357/17 |

FOREIGN PATENT DOCUMENTS

| | | | |
|---|---|---|---|
| 58-180078 | 10/1983 | Japan | 357/17 |
| 60-165772 | 8/1985 | Japan | 357/17 |
| 61-222284 | 10/1986 | Japan | 357/17 |
| 63-128775 | 6/1988 | Japan | 357/17 |

OTHER PUBLICATIONS

C. A. Stolte et al. "The Schottky Barrier Cold Cathode" Solid-State Electronics, vol. 12, pp. 945-954, Great Britain Apr. 30, 1969.

R. L. Bell et al., "Transferred Electron Photoemission From InP", Applied Physics Letters, vol. 25, No. 11, Dec. 1, 1974, pp. 645-646.

W. E. Spicer, "Negative Affinity 3-5 Photocathodes: Their Physics and Technology", Applied Physics 12, 1977, pp. 115-130.

R. E. Simon et al., "Field Induced Photoemission and Hot-Electron Emission from Germanium", J. Appl. Phys., V. 31, 1960, pp. 1505-1506.

J. S. Escher et al., "Field-Assisted Semiconductor Photoemitters for the 1-2 μm Range", IEEE Transactions on Electron Devices, vol. ED-27, No. 7, Jul. 1980, pp 1244-1249.

R. E. Simon et al., "Photoemission from Si Induced by an Internal Electric Field", Physical Review, vol. 119, No. 2, Jul. 15, 1960, pp. 621-622.

*Primary Examiner*—William D. Larkins
*Assistant Examiner*—Hung Xuan Dang
*Attorney, Agent, or Firm*—Finnegan, Henderson, Farabow, Garrett and Dunner

[57] ABSTRACT

A junction, such as a Schottky junction, is formed between a conductive electrode and a semiconductor. A bias voltage is applied between the conductive electrode and an outward-emission-side electrode formed on the semiconductor at the side opposite to the junction. Upon illumination, photoelectrons are internally emitted in the conductive electrode into the semiconductor, transported through the semiconductor, and emitted outward from the semiconductor surface, which has been so treated as to reduce the surface barrier height. The semiconductor is semi-insulating, or a p-n junction is formed therein.

12 Claims, 4 Drawing Sheets

PHOTOEMITTER

BACKGROUND OF THE INVENTION

This invention relates to a photoemitter capable of operating as a cathode in an electron tube.

No material has yet been found that has such a small energy gap and such a low work function as are practically suitable for a photoemitter having sensitivity in the long-wavelength range (longer than 1 μm). To obtain the sensitivity in the long-wavelength range, there have been proposed some prior art devices using the photoemitters which have their energy-band diagrams as shown in FIGS. 1-3 and corresponding structures as shown in FIGS. 1A, 2A, and 3A.

FIG. 1 is an energy-band diagram of a NEA (negative electron affinity)-type photoemitter fabricated by applying Cs-O treatment to a semiconductor. FIG. 1A shows the corresponding structure of the photoemitter having the energy-band diagram shown in FIG. 1. In FIGS. 1 and 1A, a p-type GaAs semiconductor substrate is shown by numeral 11 which is mounted on metal base 13, and a Cs-O compound layer joined to the substrate surface by adsorption is indicated by 12. In FIG. 1, symbols $E_c$, $E_f$, $E_v$ and $E_o$ denote the energy level at the top of the conduction band, the Fermi level, the energy level at the bottom of the valence band, and the vacuum level, respectively. The structure shown in FIG. 1A achieves reduction in work function by joining the surface level layer to the Cs-O compound layer 12.

FIG. 2 is an energy-band diagram of a photoemitter in which a p-n junction is formed in a Ge semiconductor and further the Cs-O treatment (not shown) is applied. FIG. 2A shows the corresponding structure of the photoemitter having the energy-band diagram shown in FIG. 2. As shown in FIG. 2A, a p-n junction is formed between a p-type Ge semiconductor 21 and an n-type Ge semiconductor 22. An electrode (not shown) is formed on the p-type Ge semiconductor 21 at the side opposite to the p-n junction. A partial electrode (also not shown) whose area is small enough to avoid affecting the photoemission or light incidence is formed on the n-type Ge semiconductor 22 at the side opposite to the p-n junction, i.e., at the side of a photoemitting surface. The surface barrier height of the n-type Ge semiconductor 22 is reduced by adsorption of Cs-O layer 24 on the photoemitting surface of the n-type Ge semiconductor 22. A depletion layer 23 is formed by the p-n junction and a bias voltage. The photoemitter structure is mounted on metal base 25. The structure shown in FIG. 2 achieves a substantial reduction in work function by the combined effect of the p-n junction and the reverse bias. It is noted that similar results can be attained by using a Schottky junction instead of the p-n junction.

FIG. 3 is an energy-band diagram of the photoemitter shown in FIG. 3A wherein a junction is formed between a p-type InGaAs semiconductor 31 (a material having a small energy gap) and an InP semiconductor 32 (a material having a large energy gap) and further a Cs-O layer 34 is applied to the photoemitting surface of the n-type InP semiconductor 31. An electrode (not shown) is formed on the semiconductor 31 at the side opposite of the junction, and a partial electrode (also not shown) whose area is small enough to avoid affecting photoemission or light incidence is formed on the semiconductor 32 at the side opposite to the junction, i.e., at the side of the photoemitting surface. The surface barrier height of the semiconductor 32 is reduced by adsorption of the Cs-O layer 34. A depletion layer 33 is formed by the semiconductor junction and a bias voltage. The photoemitter structure is mounted on metal base 25. The heart of the structure shown in FIG. 3A is that a material having a small energy gap and a material having a large energy gap are processed to form a junction with care being taken to minimize the interfacial barrier height in the conduction band. Further, The surface barrier height is reduced by application of a bias voltage or by some other means. Thus, a photoemitter having sensitivity in the long-wavelength range can be fabricated.

These conventional types of photoemitters which are either in the laboratory stage or commercialized are characterized in that photoelectrons are created by inter-band transition in a semiconductor and that those photoelectrons are transferred into a material having a low electron affinity by various methods and then are emitted outside.

As is understood from the foregoing description, the long-wavelength limit for the emission of photoelectrons from conventional photoemitters cannot be made longer than the wavelength determined by the energy gap of a semiconductor. In the presence of a surface barrier at the emitting surface, the long-wavelength limit is further shortened by its barrier height. Hence, in order to make a photoemitter having sensitivity in the long-wavelength range, not only is it necessary to use a semiconductor having a small energy gap but also the substantial surface barrier height must be reduced by one of the methods described above.

However, in order to achieve the reduction in the substantial surface barrier height by using a Cs-O layer as shown in FIG. 1A, the semiconductor used must have an ultraclean surface. In addition, such a clean semiconductor must form a junction with the Cs-O layer without creating an energy barrier in the conduction band. These requirements can only be met by a very sophisticated technique, and the semiconductors that can be used are also very limited.

In order to fabricate a photoemitter of the type shown in FIG. 2A, the p-n junction should have a very high breakdown voltage, because in order for photoelectrons to be emitted from the semiconductor surface while retaining the energy acquired at the p-n junction, the total thickness of the n-type layer and the depletion layer must not exceed the mean free path of the photoelectrons. Further, a reverse bias voltage high enough to overcome the surface barrier must be applied to the thin depletion layer, creating an extremely strong electric field there. This will typically cause Zener breakdown, thus making application of the reverse bias voltage impossible. What is more, semiconductors having the smaller energy gap, in general, are more likely to fail by Zener breakdown and this has been one of the biggest obstacles to the previous attempts to fabricate a desired photoemitter (i.e., having sensitivity in the long-wavelength range) by the approach shown in FIG. 2A. Even if Zener breakdown does not occur, the increase in the reverse saturation current will straightforwardly result in an increased dark current, and this causes a problem in the semiconductor material having a small energy gap. Thus, it has been difficult and impracticable to fabricate photoemitters of the type shown in FIG. 2A.

In fabricating a photoemitter of the type shown in FIG. 3A, it is important that a junction be formed without creating a barrier in the conduction band. In the presence of such a barrier, photoelectrons must have an energy beyond the barrier height and the long-wavelength limit is accordingly shortened. This barrier normally becomes high and few combinations of semiconductors are known that are capable of extending the wavelength limit into the infrared range. Further, in general, recombination centers are likely to be created at the interface of a semiconductor heterojunction and it is impossible to transfer photoelectrons with high efficiency. Hence, most of the photoemitters of the type under consideration that have been realized successfully are limited to the combinations of semiconductor materials having very similar properties. In some cases, a junction is formed between semiconductors having fairly different properties as shown in FIG. 3A but they provide only low sensitivity. In many other cases, a junction is formed between a III-V semiconductor and a ternary or quaternary semiconductor of the same families, but this approach still involves many problems such as a limited ratio of a mixed crystal and the need for adopting a very sophisticated technique.

These problems are chiefly due to the fact that the two requirements must be met at the same time; one for using a semiconductor of a small energy gap to achieve efficient photoemission by inter-band transition in a semiconductor, and the other for reducing the surface barrier height.

A photoconductor is also known that generates photoelectrons not by the inter-band transition in a semiconductor but in the barrier created by a semiconductor-metal Schottky junction. By generating photoelectrons or holes by internal photoemission from the Schottky barrier, this detector has sensitivity in the long-wavelength range. However, this detector is classified as a photodiode and no case has been known in which the photoelectrons generated in the Schottky junction are emitted outward.

SUMMARY OF THE INVENTION

An object of the present invention is to facilitate the formation of a photoemitter having sensitivity in the longwavelength range.

The photoemitter of the present invention is characterized by a structure having a conductor-semiconductor junction between a conductive material and a semiconductor, in which structure photoelectrons are internally emitted or originated by photo-irradiation into the semiconductor, then accelerated through the semiconductor, and finally emitted outward from the other surface, whereby the semiconductor is characterized by providing hot-carrier transport in an excited subband.

In the photoemitter of the present invention, photoelectrons are generated by the internal photoemission in the conductor-semiconductor junction fabricated inside the photoemitter, so the semiconductor responsible for the external emission of photoelectrons can be selected independently of its energy gap, to thereby facilitate the formation of a photoemitter having sensitivity in the long-wavelength range.

DETAILED DESCRIPTION OF THE PREFERRED EMBODIMENTS

Figure 1:
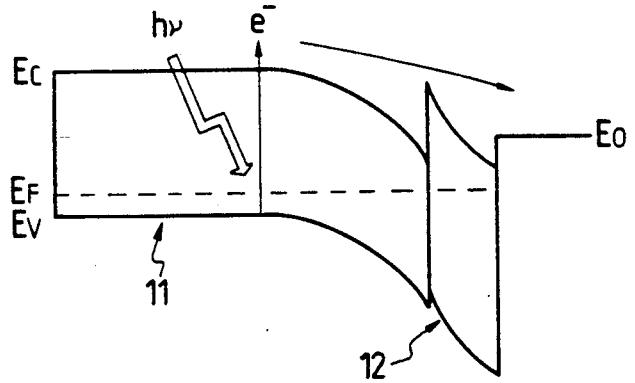
FIG. 1 PRIOR ART
FIG. 1 shows an energy-band diagram of a first prior art photoemitters.
Figure 2:
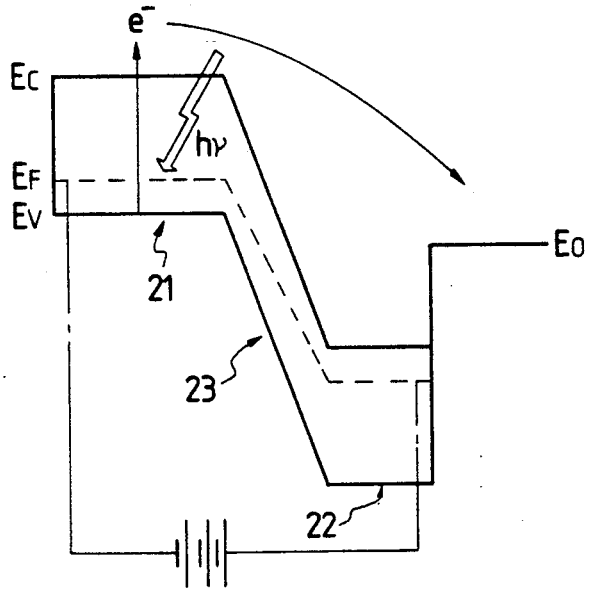
FIG. 2 PRIOR ART
FIG. 2 shows an energy-band diagram of a second prior art photoemitter.
Figure 3:
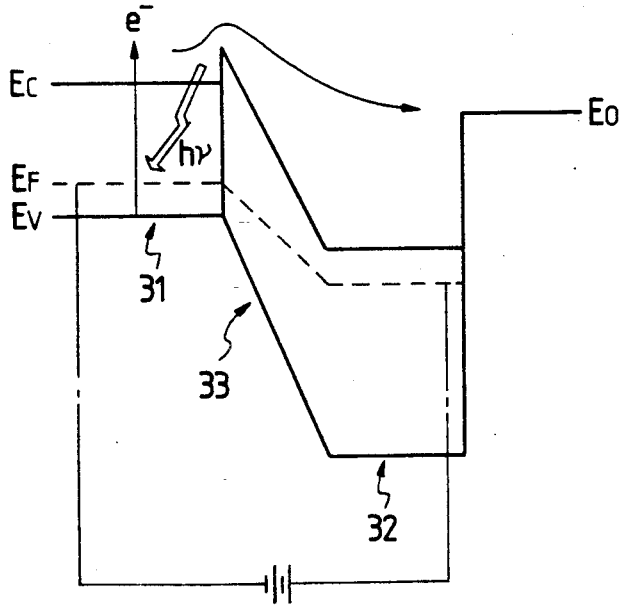
FIG. 3 PRIOR ART
FIG. 3 shows an energy-band diagram of a third prior art photoemitter.
Figure 1A:
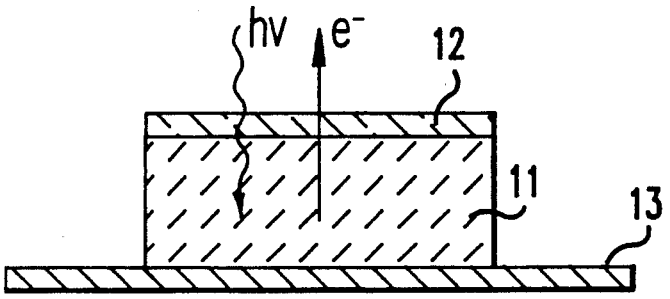
FIG.1A PRIOR ART
FIG. 1A shows the structure of the first prior art photoemitter having the energy-band shown in FIG. 1.
Figure 2A:
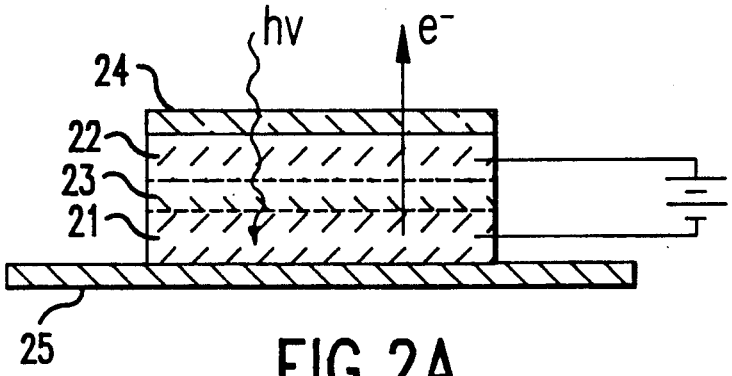
FIG.2A PRIOR ART
FIG. 2A shows the structure of the second prior art photoemitter having the energy-band diagram shown in FIG. 2.
Figure 3A:
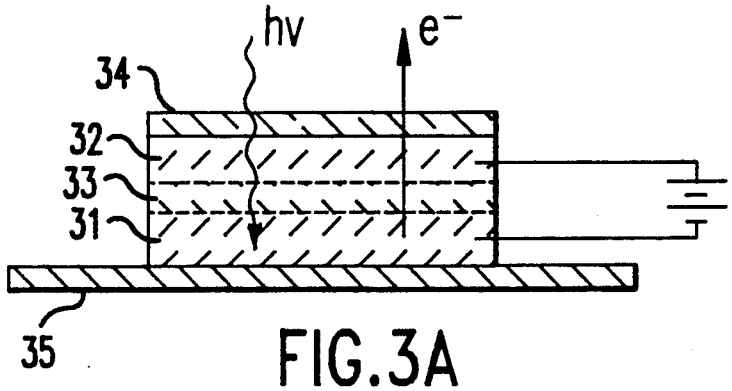
FIG.3A PRIOR ART
FIG. 3A shows the structure of the third prior art photoemitter having the energy-band diagram shown in FIG. 3.

Before going into detailed discussion of specific embodiments of the present invention, the basic feature of the invention needs to be described. The photoemitter of the present invention is characterized by having a structure in which the photoelectrons generated by internal photoemission at the junction between a conductive material and a semiconductor are emitted outward. A Schottky photodiode having a metal-semiconductor junction is available as a photodetector having sensitivity in the long-wavelength range but this makes use only of internal photoemission. In contrast, the photoemitter of the present invention is characterized by a structure in which the photoelectrons generated by such internal photoemission are thereafter emitted outward. To this end, the electrons generated by the internal photoemission are transported toward the surface by an accelerating electric field. In other words, the operating mechanism of the photoemitter of the present invention lies in cascade connection of the three steps of the internal photoemission, acceleration by an electric field, and outward-emission of electrons.

The photoemitter of the present invention has a conductor-semiconductor junction in its structure, with an energy barrier formed at the junction interface. When the conductor material is illuminated with light having a higher energy than the barrier height, electrons in the conductor clear the barrier and undergo internal photoemission into the semiconductor on the other side of the junction. The semiconductor has an electric field applied for accelerating the photoelectrons toward the other surface, which has a substantially negative barrier to permit the accelerated photoelectrons to be emitted into the vacuum. Hence, the photoemitter of the present invention is characterized in that its long-wavelength limit is determined not by the energy gap of the semiconductor as in the prior art, but by the barrier height at the conductor-semiconductor junction. Stated more specifically, the previous attempts to design a photoemitter having sensitivity in the long-wavelength range have always necessitated the use of a semiconductor having a small energy gap, but this is not necessary with the photoemitter of the present invention. Further, the junction barrier height or the long-wavelength limit, and the reduction in surface barrier height can be dealt with as independent parameters. The junction barrier height can be altered by changing the combination of materials to form the conductor-semiconductor junction.

The mechanism by which the photoelectrons transferred to the semiconductor by the internal photoemission are accelerated and transported by an electric field is an important factor of the present invention. To activate this mechanism, an electric field of at least 1 kV/cm must be applied to the inside of the semiconductor, for the purpose of which the junction between the conductor electrode and semiconductor preferably forms a blocking contact such as in the case of a Schottky junction. If desired, an ionizing electric field may be applied to the semiconductor, and in this case, not only the transport mechanism described above but also the internal current amplification can be realized. It should be understood that this special case is also included within the scope of the present invention. An electric field of at least 10 kV/cm generally suffices as the ionizing field.

Figure 4:
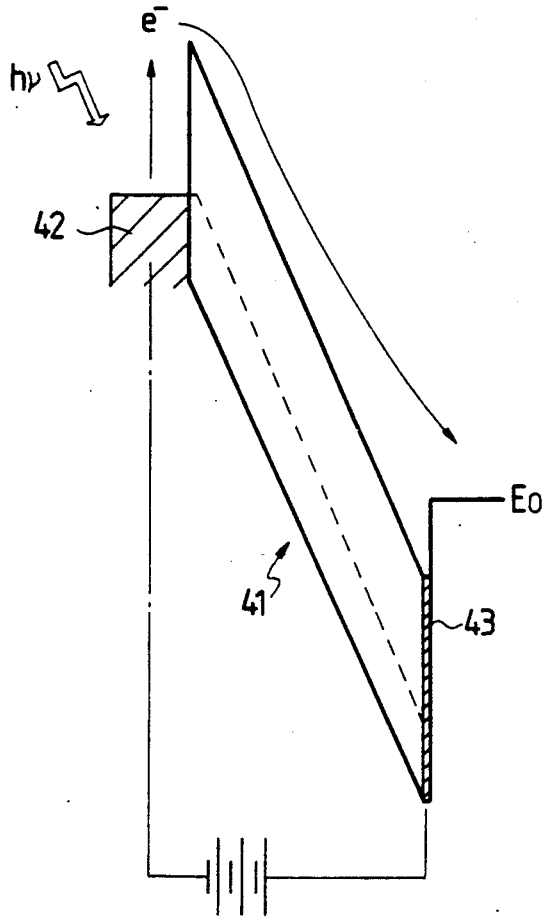
FIG. 4 shows an energy-band diagram of a first embodiment of a photoemitter made in accordance with the present invention.
Figure 4A:
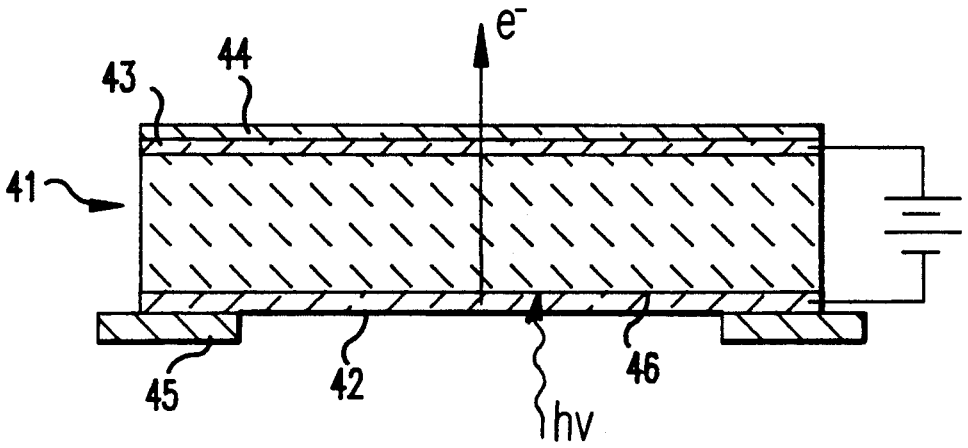
FIG. 4A shows the structure of the first embodiment of the photoemitter having the energy-band diagram shown in FIG. 4.

In the following embodiment which is shown in FIG. 4A, if the semiconductor material used has deep impurity levels, photoelectrons excited from these levels are also accelerated and penetrate through the semiconductor, because the incident light wavelength is longer than the host semiconductor material. Such photoelectrons may add to those generated by the internal photoemission from the conductor electrode which forms a junction with said semiconductor.

Various prior art techniques can be used to lower the surface barrier height. The photoemitter of the present invention has the advantage that it can be fabricated without any technical difficulties that would otherwise be imposed by material limitations in the prior art. The direction in which incident light is applied to the junction is immaterial, and there can be used not only a reflection type which permits photoelectrons to be emitted into the vacuum from the same side as the incident surface but also a transmission type which allows the photoelectrons to be emitted into the vacuum from the other side. Hence, modifications of either type are included within the scope of the present invention.

Embodiments of the present invention will now be described for the case of a metal-semiconductor junction.

FIG. 4 is an energy-band diagram of a photoemitter characterized by the use of a semi-insulating GaAs semiconductor, the application of a high electric field from electrodes, and the treatment by adsorption of Cs-O. This photoemitter is of a transmission type in which photoelectrons are emitted into the vacuum from its surface different from its light-incident surface. In this photoemitter, a metallization forms a junction with the biased semi-insulating semiconductor, and the electrons emitted from the metal to the semiconductor by the internal photoemission are transported to the other surface with high efficiency with acceleration energy by the strong electric field in the semi-insulating semiconductor. The strong electric field is applied to the semi-insulating semiconductor substrate indicated by numeral 41 in FIG. 4A, which is typically GaAs. The semiconductor substrate 41 forms a junction with a conductive material 42 (e.g., WSi), where the barrier is to be cleared by the internal photoemission. The electrode 43 is formed on the surface to apply a bias voltage to the semi-insulating substrate 41. The electrode 42 can be a thin semi-transparent conductive layer. The electrode 43 is either a thin-film or mesh electrode so that it will not obstruct the emission of photoelectrons into the vacuum. Outward-emission means 44 is formed on semiconductor substrate 41 and is formed, for example, of a layer of at least one of alkaline metals and alkaline metal oxides such as Cs-O. The photoemitter structure is mounted on a metal base 45.

As already mentioned, the mechanism by which electrons are accelerated and transported through the semiconductor by the electric field is an important factor of the present invention. The threshold field strength for electrons to become hot carriers under the electric field in a semiconductor is 1 kV/cm for GaAs, and efficient photoemission is realized above such a threshold field. This is because the hot carriers are permitted to exist in the L-band in non-thermal equilibrium to provide improved conduction and emission efficiency. Thus, the semiconductors that can be used in the present invention are those which have the ability to cause the Γ to L transition, and typical examples are GaAs and InP. These features can be identified experimentally by the occurrence of some discontinuity negative resistance or oscillation in the current vs voltage characteristic upon application of an electric field with a strength of at least one kilovolt/cm.

To assure a low dark current even under the high electric field, a high-resistivity semiconductor, typically semi-insulating GaAs, is safely applied. Deep-level impurities are usually incorporated to prepare a semi-insulating material.

A transport length for greater than the mean free path of hot electrons is not appropriate since the photoelectrons are extinguished as they travel that distance. Ideally, the thickness of the semiconductor substrate is, preferably, not greater than about 0.1 μm but a practical level of sensitivity was successfully obtained even with a sample as thick as 400 μm (0.1 mA/W at 1200 nm).

The barrier height for the internal emission depends on the type of conductor material and is not specified, but it will correspond to the wavelength of the incident light in the range of 1.3–1.7 μm since the barrier height takes a value of one half to one third of the band gap energy of GaAs, which is 1.4 eV.

The photoemitter shown in FIG. 4A is of a transmission type. If desired, as described above, a photoemitter of a reflection type may be constructed. In the example under consideration, the mesh-like surface electrode 43 is employed to apply a bias voltage to the GaAs semiconductor without obstructing the photoelectrons. If the electrode is so thin that electrons are capable of passing through it without losing energy, it need not be a mesh electrode. It should also be noted that the electrode material is not limited to metals.

Figure 5:
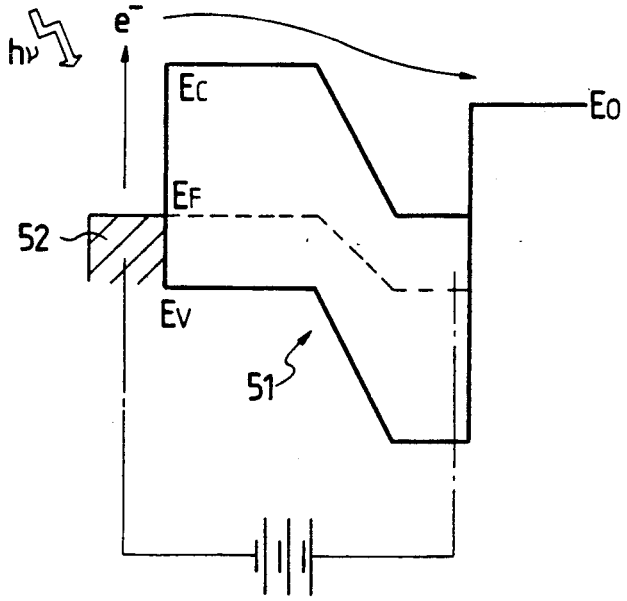
FIG. 5 shows an energy-band diagram of a second embodiment of a photoemitter made in accordance with the present invention.
Figure 5A:
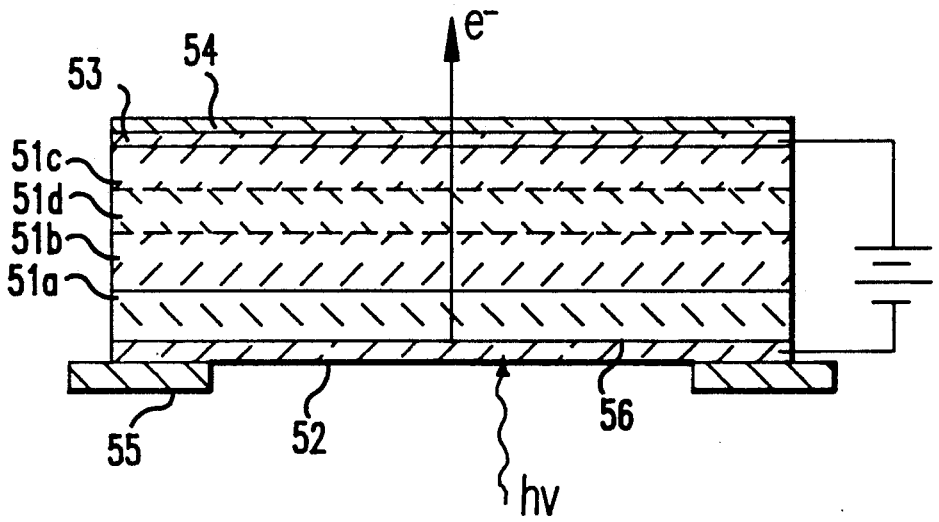
FIG. 5A shows the structure of the second embodiment of the photoemitter having the energy-band diagram shown in FIG. 5.

FIG. 5A shows a photoemitter comprising a semiconductor substrate which is comprised of a semi-insulating GaAs layer **51*a*, a p-type GaAs layer 51*b* formed on the semi-insulating GaAs layer 51*a*, and a depletion layer 51*d* formed between the p-type GaAs layer 51*b* and a n-type GaAs layer 51*c*. Thin-film electrode 52, which is made of WSi, for example, and another thin-film electrode 53, which is made of Al, for example, are provided on the semi-insulating GaAs layer 51*a* and the n-type GaAs layer 51*c*, respectively, for applying a bias voltage to the semiconductor substrate. Thin-film electrode 52 and semi-insulating GaAs layer 51*a* form a junction 56**. A layer of Cs-O may be provided on the emitting-side surface of the semiconductor substrate.

The photoemitter structure may be mounted on metal base 55.

FIG. 5 is an energy-band diagram of a photoemitter having the structure of FIG. 5A in which a reverse-biased semiconductor having a p-n junction is used as a semiconductor substrate having a substantially negative surface barrier. Photoelectrons internally emitted from a back-side electrode 52 acquire energy from the reverse bias and are emitted into the vacuum over the surface barrier. As already mentioned, if a semiconductor having a small energy gap is used, the p-n junction generally has a low breakdown voltage and a sufficient energy to accelerate electrons cannot be imparted. With the photoemitter of the present invention, however, there is no need to use such a semiconductor having a small energy gap, so a p-n junction having a high breakdown voltage can be applied, and electrons can easily be emitted into the vacuum over the surface barrier. An increase in the reverse saturation current will straightforwardly result in an increased dark current, if not in Zener breakdown, so compared to the case where a p-n junction is formed using a semiconductor having a small energy gap, the photoemitter of the present invention has the advantage of producing only a limited dark current. The photoemitter shown in FIG. 5A uses a p-n junction, but needless to say, similar results can be attained even if a Schottky junction is used. It also goes without saying that the long-wavelength limit is determined in the same way as in the embodiment shown in FIG. 4.

The two embodiments described above are only intended to illustrate the method for creating a substantially negative surface barrier in the semiconductor which is to form a junction with a metal. Other methods can of course be used to attain the same object. The essence of the present invention is to provide a photoemitter having a structure in which internally emitted photoelectrons are accelerated in the semiconductor under an applied electric field and thence emitted into the vacuum.

Photoemitters having sensitivity in the infrared range have been difficult to fabricate by the prior art techniques. Extension of sensitivity to fairly long wavelengths has been reported to be successful in the laboratory, but the only commercial one that has proved to have sensitivity at wavelengths longer than 1 μm is what is called an "S-1" photoemitter which is composed of Ag, O and Cs. Even the sensitivity of this photoemitter is extremely small. Also, the photodetectors of internal photoconduction type (e.g., InSb and PbS) that are currently used in the infrared range have a sensitivity, but they are not suitable for the detection at the very faint light level. This is because most of these internally photoconductive detectors produce an extremely large amount of dark current, and therefore considerable difficulty is involved in detecting the weak photocurrent. With photodetectors that utilize the photovoltaic effect, it is also difficult to perform low-noise amplification of the low output signal with an external amplifier to a level that can be handled easily, because the amplifier will produce substantial noise.

If, on the other hand, the photoemitter of the present invention is applied to a photomultiplier tube, extremely low-noise multiplication of secondary electrons can be utilized to permit very faint light to be detected, although the attainable detection efficiency tends to be lower than that of internal photoconduction-type detectors. Accordingly, the present invention offers the advantage of extending various studies and devices in the very faint light region from the current visible range to the infrared range. In materials studies, for example, the studies of impurity levels using luminescence in the infrared range have heretofore involved considerable difficulty on account of the low sensitivity of photodetectors, but this problem can be effectively solved by the present invention. The photoemitter of the present invention may be combined with an imaging system to construct a camera capable of detecting very faint light in the infrared range. As a result, hot objects can be observed at a very faint light level, or night vision can be provided with illumination by infrared light. As a further advantage, a photodetector having the fastest response in the infrared range can be realized by applying the photoemitter of the present invention to a streak camera which captures light in the form of emitted photoelectrons which are then deflected to produce a temporal image on the screen.

What is claimed is:

1. A photoemitter comprising:

a semiconductor substrate formed of a semi-insulating material of a type in which a Γ-L transition can occur by application of an electric field;

conductive electrode means, provided on one surface of said semiconductor substrate, for forming a junction barrier with said semiconductor substrate, and for internally emitting photoelectrons which are capable of clearing said junction barrier into said semiconductor substrate in response to illumination by light; and an emitting-side electrode formed on an opposite side of said semiconductor substrate for emitting the photoelectrons outward;

wherein a bias voltage is applied between said conductive electrode and said emitting-side electrode so that an electric field of at least 1 kV/cm is applied to said semiconductor substrate.

2. The photoemitter according to claim 1, wherein said semiconductor substrate is formed of a material that includes deep-level impurities, for emitting photoelectrons in response to illumination by light.

3. The photoemitter according to claim 1, wherein said semiconductor substrate is formed of a material that comprises GaAs.

4. The photoemitter according to claim 1, wherein the thickness of said semiconductor substrate is not more than 0.1 μm.

5. The photoemitter according to claim 1, wherein said electric field applied to said semiconductor substrate is at least 10 kV/cm.

6. The photoemitter according to claim 1, wherein said junction barrier is a Schottky junction.

7. The photoemitter according to claim 1, wherein a p-n junction is formed within said semiconductor substrate.

8. The photoemitter according to claim 1, further comprising:

outward-emission means, formed between said opposite surface of the semiconductor substrate and said emitting-side electrode, for reducing the surface barrier height of said semiconductor substrate.

9. The photoemitter according to claim 8, wherein outward-emission means comprises a surface layer formed on said semiconductor substrate through a treatment using at least one of alkaline metals and alkaline metal oxides.

10. The photoemitter according to claim 9, wherein said outward-emission means comprises a Cs-O compound layer formed by absorption.

11. The photoemitter according to claim 1, wherein said emitting-side electrode is a thin-film electrode.

12. The photoemitter according to claim 1, wherein said emitting-side electrode is a mesh electrode.

* * * * *